US008133091B2

(12) United States Patent
Liu

(10) Patent No.: US 8,133,091 B2
(45) Date of Patent: Mar. 13, 2012

(54) BRASSIERES

(75) Inventor: Zhen Qiang Liu, Kwai Chung (HK)

(73) Assignee: Regina Miracle International Limited, Kwai Chung (HK)

( * ) Notice: Subject to any disclaimer, the term of this patent is extended or adjusted under 35 U.S.C. 154(b) by 660 days.

(21) Appl. No.: 12/272,251

(22) Filed: Nov. 17, 2008

(65) Prior Publication Data

US 2010/0124869 A1 May 20, 2010

(51) Int. Cl.
*A41C 3/00* (2006.01)

(52) U.S. Cl. ..... 450/92; 450/39; 450/57

(58) Field of Classification Search ..... 450/37, 450/38, 39, 54–57, 1, 92, 93; 2/267, 268
See application file for complete search history.

(56) References Cited

U.S. PATENT DOCUMENTS 2,727,278 A * 12/1955 Thompson ..... 264/46.4
3,202,565 A * 8/1965 Loftin ..... 428/175
4,375,445 A * 3/1983 Cole et al. ..... 264/250
4,481,951 A * 11/1984 Cole et al. ..... 450/20
6,398,620 B1 * 6/2002 Huang ..... 450/57
6,805,612 B1 10/2004 Luk
7,192,332 B2 * 3/2007 Liu ..... 450/39
7,198,540 B2 * 4/2007 Liu ..... 450/39
7,407,427 B2 * 8/2008 Liu ..... 450/39
7,563,152 B2 * 7/2009 Liu ..... 450/39

* cited by examiner

*Primary Examiner* — Gloria Hale
(74) *Attorney, Agent, or Firm* — Gilman Pergament LLP

(57) ABSTRACT

A bra comprising two bra cups is defined. Each bra cup preferably comprises an outermost fabric layer and an innermost fabric layer and at least one intermediate layer intermediate of the outermost fabric layer and the innermost layer. The outermost fabric layer at at least part of at least one of the neckline edge region and underarm edge region of each cup is folded over the intermediate layer and secured at the inner side of the breast cup, preferably joined to the innermost layer through ultrasonic welding. The folded-over portion of the outermost layer is contiguous with and does not overlap the innermost layer. The intermediate layer extends beyond the innermost layer at the neckline edge region and the underarm edge region so that a reduction in thickness is defined at the neckline edge region and the underarm edge region. A method of making the same is also provided.

52 Claims, 9 Drawing Sheets

BRASSIERES

FIELD OF THE INVENTION

The present invention relates to improvements to brassieres and brassiere cups and methods of making same.

BACKGROUND

Brassieres (hereinafter "bra") and bra cups of a kind which can be made from a plurality of layers of plies of material which have been subjected to molding and trimming are known. Molded bras and bra cups offer the benefit of convenient construction since the materials used often lend themselves conveniently to the introduction of a three dimensional cup shape by a molding device. Such a device is normally a molding press having appropriately shaped upper and lower mold portions, intermediate of which a pre-form planar ply or assembly of plies of materials can be placed whereupon the molding press can then introduce the three dimensional shape into the plies.

Aesthetics and comfort factors are important factors to consider in such molded bras or bra cups, as such factors will distinguish the final product from competing products at the point of sale.

It has been an issue in respect of bras and bra cups of the molded kind, to ensure that the perimeter or edge of the bra or bra cup is capable of being defined in a robust manner, while paying attention to the aesthetic and comfort factors. In known molded bra cups or bras made of an assembly of layers of material, perimeter or edge finishing is accomplished by any of the following known methods: stitching, ultrasonic welding or hemming. A known method of hemming is described in US 2006/0105674, the content of which is herein incorporated by reference, where a hem is formed through the folding of the outermost layer over an edge of the bra or bra cup with the folded-over portion being adhered through adhesive means to the innermost layer. The problem with such hemming method is that where there is hemming at the perimeter or edge of the bra or bra cup, the thickness of the bra cup is increased by the folded-over portion and such increased thickness may be undesirable from an aesthetic or comfort point of view. In such method, as the folded-over portion overlaps the innermost layer, there is also the problem of reduced comfort caused by a stepped transition from the folded-over portion of the outermost layer to the innermost layer on the concave side of the bra cup which is in contact with the wearer's skin.

Accordingly, it is an object of the present invention to provide an improved bra or bra cup which addresses the abovementioned disadvantages or which will at least provide the public with a useful choice.

It is also an object of the present invention to provide a method of manufacturing which results in a bra or bra cup which addresses the abovementioned disadvantages or which will at least provide the public with a useful choice.

BRIEF DESCRIPTION OF THE INVENTION

In a first aspect of the present invention there is a bra cup comprising a convex or outer side, a concave or inner side, a neckline edge and an underarm edge, the bra cup further comprising:

an outer layer of material on the convex side of the bra cup, an inner layer of material on the concave side of the bra cup, the inner layer of material having a neckline edge corresponding to the neckline edge of the bra cup and an underarm edge corresponding to the underarm edge of the bra cup, and an intermediate layer of material located between the outer layer of material and the inner layer of material, the intermediate layer of material having a neckline edge corresponding to the neckline edge of the bra cup and an underarm edge corresponding to the underarm edge of the bra cup, wherein the outer layer of material is folded over at least part of at least one of the neckline edge and the underarm edge of the intermediate layer of material to the concave side of the bra cup and the folded-over portion of the outer layer of material is contiguous with and does not overlap the inner layer of material.

In another embodiment, the outer layer of material is folded over the neckline edge and the underarm edge of the intermediate layer of material to the concave side of the bra cup and the folded-over portion of the outer layer of material is contiguous with and does not overlap the inner layer of material.

The folded-over portion of the outer layer of material can be secured at the concave side of the bra cup.

The folded-over portion of the outer layer of material can be engaged to the inner layer of material at an edge or at least part of an edge of the inner layer of material.

The folded-over portion of the outer layer of material can be joined to the inner layer of material through ultrasonic welding.

On the concave side of the bra cup, the folded-over portion of the outer layer of material can be in contact with and affixed to the intermediate layer of material.

The folded-over portion of the outer layer of material can be adhesively affixed to the intermediate layer of material.

The intermediate layer of material can be a foam layer, and the outer and inner layers of material can be fabric layers.

The intermediate layer of material can be made of polyurethane foam.

Preferably the bra cup includes two zones, the first zone being a zone corresponding to where the folded-over portion of the outer layer of material is present on the concave side of the bra cup, and the second zone being a zone corresponding to where the folded-over portion of the outer layer of material is not present on the concave side of the bra cup, wherein the thickness or the average thickness of the bra cup at the first zone is less than the thickness of the bra cup at the second zone or at a substantial part of the second zone.

The thickness or the average thickness of the bra cup at the first zone can be less than the thickness of the bra cup at the second zone immediately next to the first zone.

Preferably the total number of layers of material at the first zone is less than the total number of layers of material at the second zone or at a substantial part of the second zone.

Preferably the total number of layers of material at the first zone is less than the total number of layers of material at the second zone immediately next to the first zone.

The bra cup can further comprise a second foam layer, wherein the second foam layer can be laminated with the intermediate layer of material.

The second foam layer can have a neckline edge corresponding to the neckline edge of the bra cup and an underarm edge corresponding to the underarm edge of the bra cup, wherein at least part of at least one of the neckline edge and the underarm edge of the second foam layer preferably does not touch the corresponding neckline edge or underarm edge of the intermediate layer of material.

Preferably the neckline edge and the underarm edge of the second foam layer do not touch, or are not contiguous with, the corresponding neckline edge and underarm edge of the intermediate layer of material. Preferably there is a gap between the neckline edge and underarm edge of the second foam layer and the corresponding neckline edge and underarm edge of the intermediate layer of material.

The second foam layer can be laminated with the inner layer of material while the neckline and underarm edges of the second foam layer can be contiguous with the corresponding neckline and underarm edges of the inner layer of material.

The bra cup can further comprise a fabric layer, the fabric layer preferably being located between the outer layer of material and the inner layer of material.

The fabric layer can be laminated with the intermediate layer of material.

Preferably the fabric layer is not laminated with the outer layer of material.

Preferably on the convex side of the bra cup, the outer layer is not laminated with the intermediate layer of material.

The fabric layer can have a neckline edge corresponding to the neckline edge of the bra cup and an underarm edge corresponding to the underarm edge of the bra cup, wherein at least part of at least one of the neckline edge and/or the underarm edge of the fabric layer preferably does not touch the corresponding neckline edge or underarm edge of the inner layer of material.

Preferably the neckline edge and the underarm edge of the fabric layer do not touch, or are not contiguous with, the corresponding neckline edge and underarm edge of the inner layer of material.

The neckline and underarm edges of the fabric layer can be contiguous with the corresponding neckline and underarm edges of the intermediate layer of material.

Preferably at least part of at least one of the neckline edge and/or the underarm edge of the inner layer of material does not touch the corresponding neckline edge or underarm edge of the intermediate layer of material.

Preferably the neckline edge and the underarm edge of the inner layer of material do not touch, or are not contiguous with, the corresponding neckline edge and underarm edge of the intermediate layer of material.

The folded-over portion of the outer layer of material on the concave side of the bra cup can be a width of between 2 to 6 mm.

The bra cup can be a molded bra cup.

In another embodiment, the present invention comprises a bra comprising a bra cup as hereinbefore described.

In another embodiment the present invention preferably comprises a molded bra comprising two bra cups and a chest band engaged to each of the two bra cups, and having an outer side and an inner side and an upper edge and a lower edge, the bra preferably further comprising:

an outer layer of material on the outer side of the bra, an inner layer of material on the inner side of the bra, the inner layer of material preferably having an upper edge corresponding to the upper edge of the bra, and an intermediate layer of material located between the outer layer of material and the inner layer of material, the intermediate layer of material preferably having an upper edge corresponding to the upper edge of the bra and is laminated with the inner layer of material, wherein the outer layer of material is preferably folded over at least part of the upper edge of the intermediate layer of material to the inner side of the bra and the folded-over portion of the outer layer of material is contiguous with and preferably does not overlap the inner layer of material.

There can be intervening layer(s) of material between the intermediate layer of material and the inner layer of material.

There can also be intervening layer(s) of material between the outer layer of material and the intermediate layer of material. On the convex side of the bra cup, preferably the outer layer of material is not laminated with the intermediate layer of material.

The folded-over portion of the outer layer of material can be secured at the inner side of the bra. If so, it is preferably engaged to the inner layer of material at an edge or at least part of an edge of the inner layer of material.

The folded-over portion of the outer layer of material can be joined to the inner layer of material through ultrasonic welding.

On the inner side of the bra, the folded-over portion of the outer layer of material can be in contact with and/or affixed to the intermediate layer of material.

The folded-over portion of the outer layer of material can be adhesively affixed to the intermediate layer of material.

The intermediate layer of material can be made of foam.

Each of the bra cups can have a neckline edge and an underarm edge wherein the intermediate layer of material has neckline edges and underarm edges corresponding to the neckline edges and underarm edges of the bra cups, and further wherein the at least part of the upper edge of the intermediate layer of material preferably includes a substantial part of the neckline edges and underarm edges of the intermediate layer of material.

In another embodiment, the present invention comprises a method of forming a bra cup, the method preferably comprising the steps of:

a) Forming a precursor bra cup by laminating at least a substantial portion of at least an outer layer of material, an intermediate layer of material, and an inner layer of material, and molding the layers of material to a cup shape;

b) At a set distance inward from at least one of a neckline edge and an underarm edge of the precursor bra cup, trimming at least the inner layer of material, but excluding the outer layer of material and the intermediate layer of material, to result in a reduction in thickness of the precursor bra cup at at least a region in the vicinity of the neckline edge and/or the underarm edge of the precursor bra cup; and c) Placing an outermost layer of material over the outer layer of material in such a manner that the outermost layer of material is folded over at least part of at least one of a neckline edge and an underarm edge of the intermediate layer of material to a concave side of the bra cup and the folded-over portion is contiguous with and does not overlap the inner layer of material.

The method may further comprise the step of securing the outermost layer of material at the concave side of the bra cup.

The method may further comprise the step of engaging the folded-over portion of the outermost layer of material to the inner layer of material at an edge or at least part of an edge of the inner layer of material.

The method may further comprise the step of affixing the folded-over portion of the outermost layer of material on the concave side of the bra cup to the intermediate layer of material.

The affixing can be accomplished by adhesive means.

The method may further comprise the step of joining at least part of an edge of the outermost layer of material to at least part of an edge of the inner layer of material by ultrasonic welding.

The method may further comprise the step of joining at least part of an edge of the folded over portion of the outermost layer of material to at least part of an edge of the inner layer of material by ultrasonic welding.

The trimming in step b) can be accomplished by ultrasonic cutting.

The method may further comprise, prior to step b), the step of affixing the outermost layer of material to the inner layer of material.

In yet another embodiment, the present invention may comprise in a bra that includes two breast cups, each breast cup comprising an outermost fabric layer and an innermost layer and at least one intermediate layer that comprises a foam layer that is intermediate of at least part of the outermost fabric layer and inner most layer, wherein the outermost fabric layer at at least part of at least one of the neckline perimeter region and underarm perimeter region of each cup, defines such perimeter region(s) by providing a hem region of said outermost fabric layer, secured at the innermost layer side of said breast cup.

For each breast cup, the hem can be secured at the innermost layer side of the breast cup, relative the foam layer.

The hem can be secured to the innermost layer.

The hem can be engaged to the inner most layer at a perimeter region of the inner most region.

The perimeter region or regions of the innermost layer at at least those parts thereof corresponding to where the hem is provided, can be complementary but preferably not contiguous the corresponding perimeter region or regions of at least one intermediate layer so as to be set away from the perimeter region(s) of the at least one intermediate layer.

The perimeter region or regions of the innermost layer at at least those parts thereof corresponding to where the hem is engaged thereto, can be complementary but preferably not contiguous the corresponding perimeter region or regions of at least one intermediate layer so as to be set away from the perimeter or perimeters of said at least one intermediate layer.

Preferably this provides a reduced thickness of the cup at such perimeter region(s).

Preferably at least two intermediate layers are provided, one of which is the foam layer and wherein the perimeter region or regions of the innermost layer at at least those parts thereof corresponding to where the hem is engaged thereto, is/are contiguous the perimeter region(s) of at least one of the intermediate layers.

Preferably there are two intermediate foam layers.

The two intermediate foam layers can be juxtaposed each other.

The foam layer proximate more the innermost layer can have a perimeter region or regions that correspond with the region or regions where the hem is provided, that are contiguous at such region(s) with the perimeter of the innermost layer.

The foam layer distal more the innermost layer can have a perimeter region or regions that correspond with the region or regions where the hem is provided, that are contiguous the neckline perimeter region and underarm perimeter region at such region(s)

The intermediate layer can include an intermediate fabric layer that is provided on the distal more side of the foam layer relative to the inner most layer, said fabric layer positioned juxtaposed the outermost fabric layer.

The intermediate fabric layer can have a perimeter region(s) that is contiguous the neckline perimeter region and underarm perimeter region.

The outermost fabric layer can be secured at the hem at the innermost layer side of the breast cup by ultrasonic welding.

The outermost fabric layer can be secured at the hem in a manner such that the side of the outermost fabric layer at the hem that is also the outward facing side of the outermost fabric layer is the side in contact at the innermost side of the breast cup.

The outermost fabric layer can be secured to the innermost layer at the hem in a manner such that the side of the outermost fabric layer at the hem that is also the outward facing side of the outermost fabric layer is the side in contact with the inner most layer.

The outermost fabric layer can be juxtaposed the intermediate layer but is not affixed thereto.

The intermediate layers can be laminated with each other.

The innermost layer can be laminated with the intermediate layers.

The outermost fabric layer is preferably not affixed by being laminated to any of the layers, other that at its perimeter region.

The innermost layer can be a fabric layer.

The bra can be a molded bra.

The bra can be a seamless bra.

In another aspect, the present invention comprises a method of forming a breast cup of, or for, a bra, comprising:

trimming, a set distance inward from a perimeter that is to correspond to at least part of the underarm and/or neckline perimeter of the breast cup, at least one of the layers of an assembly of layers that are overlaying each other at least at said perimeter, to define a reduction in the thickness of the assembly of layers at at least part of the underarm and/or neckline perimeter, said assembly of layers including a fabric layer and an innermost layer, folding said fabric layer, secured by way of a hem thereof to the innermost layer, about the at least part of the underarm and/or neckline perimeter to dispose substantially all but the hem of the fabric layer on the outermost side of the breast cup, the fold of the fabric layer defining the such part of the underarm and/or neckline perimeter.

The fabric layer can be secured to the innermost layer prior to trimming, and the trimming is of at least the fabric layer and the innermost layer.

Prior to the folding, the fabric layer can be positioned against the innermost layer, with the side of the fabric layer to be positioned outermost in contact with the innermost layer.

In yet another embodiment, the present invention comprises a bra that includes two breast cups, each breast cup comprising an outermost fabric layer and an innermost layer and at least one intermediate layer that comprises a foam layer that is intermediate of at least part of the outermost fabric layer and inner most layer, wherein the outermost fabric layer at at least part of at least one of the neckline perimeter region and underarm perimeter region of each cup, defines such perimeter region(s) by providing a hem region of said outermost fabric layer, secured at the innermost layer side of said breast cup to the innermost layer at a perimeter region of the inner most region, wherein the perimeter region or regions of the innermost layer at at least those parts thereof corresponding to where the hem is engaged thereto, is/are complementary but not contiguous the corresponding perimeter region or regions of the at least one of the intermediate layer so as to be set away from the perimeter or perimeters of said at least one intermediate layer to define a reduction in thickness of the breast cup at said perimeter region or regions.

In another embodiment, the present invention comprises a bra that includes two breast cups, each breast cup comprising an assembly of layers comprising a. outermost fabric layer, b. an innermost layer, and c. at least one intermediate layer comprising a foam layer that is intermediate of at least part of the outermost fabric layer and inner most layer wherein the outermost fabric layer at at least part of at least one of the neckline perimeter region and underarm perimeter region of each cup has a hem region thereof secured to the innermost layer at a perimeter region of the inner most region, wherein at least part of said perimeter region of at least the inner most layer is parallel to and set inwards away from the perimeter of at least one of the other layers of the assembly of layers.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

Where reference herein is made to inner and outer or similar terminology in relation to component parts or items of the bra or part of the bra, it is meant to be understood to be in relation to the body of a wearer of the bra. For example the "interior" or "inner side" or "inner region" is a relative term to denote that an item is more proximate the face side of the bra that is more proximate to the body of the wearer than some or all items of the bra that are more distal the body of the wearer. "Inner" does not necessarily mean "inner most" unless specified. This similarly applies to terms such as "outer" or "exterior".

Where there is reference to the word "layer" it is to be understood that it may have its common definition and, but not limited to that the layer could consist of one panel or may have regions that are defined by two or more panels that are joined and that may each be of a different characteristic (e.g. color, thickness, material, orientation, size).

Where there is reference to the word "layer" it is to be understood that it may have its common definition and, but not limited to that the layer may be of one ply or of more plies of the same or dissimilar characteristics (e.g. color, thickness, material, orientation, size) that may be engaged to each other such as by lamination or other in an at least partial overlapping and/or lapping configuration.

As used herein the term "and/or" means "and" or "or", or both.

As used herein "(s)" following a noun means the plural and/or singular forms of the noun.

When interpreting statements in this specification which include the term "comprising", the features prefaced by that term in each statement all need to be present but other features can also be present. Related terms such as "comprise" and "comprised" are to be interpreted in the same manner.

BRIEF DESCRIPTION OF THE DRAWINGS

A preferred form of the present invention will now be described with reference to the accompanying drawings in which.

DETAILED DESCRIPTION OF THE INVENTION

Figure 1:
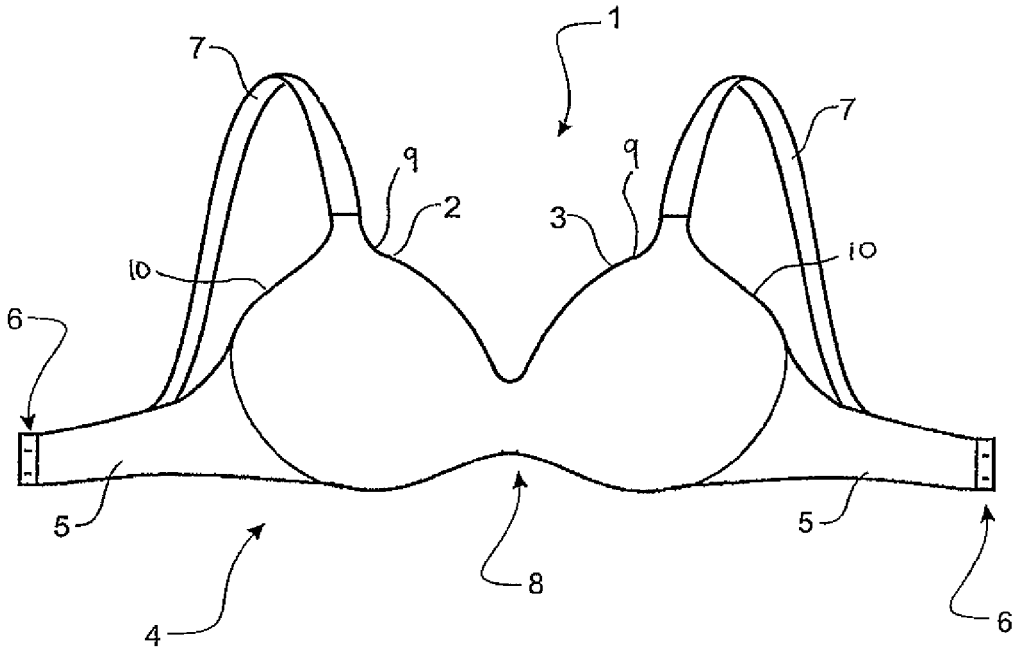
FIG. 1 is a front view of a bra.

With reference to FIG. 1 there is shown a bra 4 that may generally be defined by a breast cup region 1, chest bands 5 and shoulder straps 7. The shoulder straps 7 may extend between the breast cup region 1 and each of the chest bands 5.

Such over the shoulder straps may however be optional as it is envisaged that the bra may also be of a strapless version. Indeed whilst reference is herein made to a bra, it is envisaged that the assembly of panel component parts and items to define such, may alternatively be incorporated into other garments such as, for example, evening dresses or bathing suits or similar.

At the ends of each of the chest bands may be fasteners 6 that are mutually cooperative to allow for the bra 4 to be fastened about the chest of a wearer. Other fastening mechanisms known in the art are anticipated herein.

The bra may be made from materials at least some of which are molded or moldable and that are engaged to each other preferably at least in part by lamination. Heat and pressure and/or adhesives are generally applied during such lamination. In one preferred form, the bra is a one-piece bra, so that at least the outermost layer and the innermost layer of the bra are each a continuous piece of, for example, fabric layer or layer of any other suitable material.

As can be seen with reference to FIG. 1 the components defining the breast cup region 1 may be fastened to the components defining the chest band 5 and the shoulder strap 7. Such fastening may occur by adhesive and/or ultrasonic welding or other forms of welding and/or by stitching. Stitching is not the preferred form of assembly. In a preferred form the bra of the present invention is a seamless bra that incorporates little or no stitching at all. With reference to FIG. 1 it can be seen that a bra 4 of the present invention can be made from discrete components such as the breast cups and the chest bands that are during the manufacture of the bra fastened together.

The breast cup region 1 preferably defines two breast cups 2 and 3 that are adjacent to each other and between which may extend an intermediate bridge region 8. At least some of the material components defining the breast cups 2 and 3 may be continuous over the entire breast cup region 1, including across the bridge region 8. Alternatively some or all of the material components may only be present at at least part of the breast cups 2 and 3.

In one form, at least one of the layers of the breast cup region 1 is preferably continuous over the breast cup region 1 and preferably also over the bridge region 8. However in alternative forms each of the breast cups 2 and 3 may be separately predefined and may be affixed together at the bridging region 8 to define, once assembled, a breast cup region 1.

The bra includes a neckline edge 9 at each of the breast cups 2 and 3. The neckline edge 9 may be continuous over the two breast cups or may be discretely defined for each breast cup. The neckline edge generally extends from an upper region of each breast cup preferably where the shoulder straps 7 are engaged to the breast cup, to or towards the bridge region 8. The neckline edge 9 can be continuous and extends from shoulder strap to shoulder strap, for example as in a one-piece bra where at least the outermost layer and the innermost layer of the bra are continuous one-piece layers. The neckline edge 9 generally sits above a substantial part of the breast of the wearer. The neckline edge region is often that part of the bra that is exposed through the likes of the necked tops or shirts. It is also that part of the bra against which clothing may cling or sit tightly against.

The bra also includes a underarm edge 10 at each of the breast cups 2 and 3. The underarm edge 10 generally extends from an upper region of the breast cup, to which region the shoulder strap 7 is engaged, to or towards the region where the chest band 5 is engaged to the breast cup. The underarm edge region is the part of the bra which is located adjacent to the underarm of a wearer of the bra.

Additional components, layers or plies of material may be provided with the materials defining the breast cup region and/or the bra, to those herein defined.

Variations to the bra shown in FIG. 1 may include where the chest bands 5 are unitary and may extend along the lower edge of the breast cup region 1. The bra may be a front opening bra where mutually cooperative fasteners are positioned at the bridge region 8 to allow the bra to be opened and fastened at that region.

The present invention concerns in particular the edge finishing of a molded bra cup 2 or 3, especially the edge finishing at the neckline edge 9 and the underarm edge 10.

The method of edge finishing of a bra cup of the present invention will now be described with reference to FIGS. 2 to 17.

Figure 7:
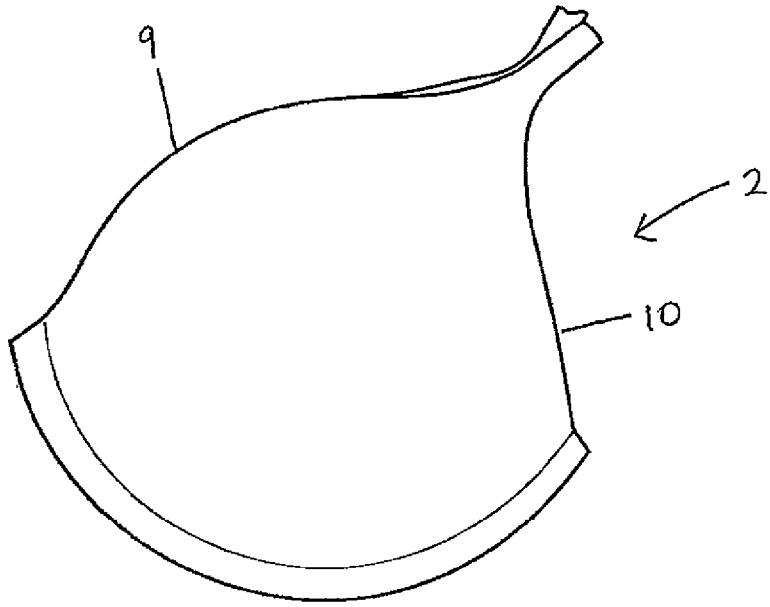
FIG. 7 is a view of a bra cup looking at the outside (convex side)
Figure 8:
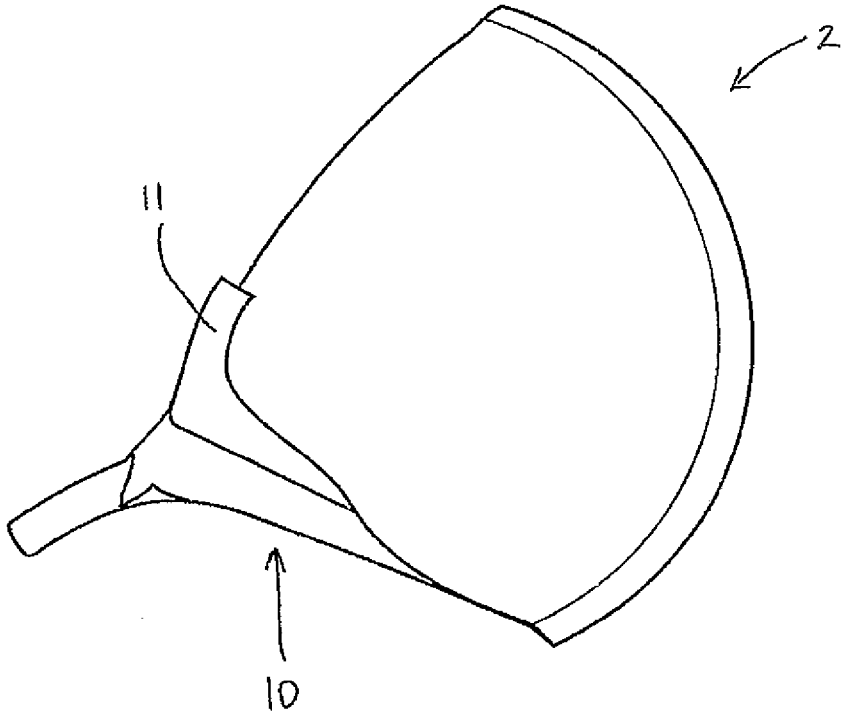
FIG. 8 is a view of the bra cup of FIG. 7 looking at the inside (concave side)
Figure 9:
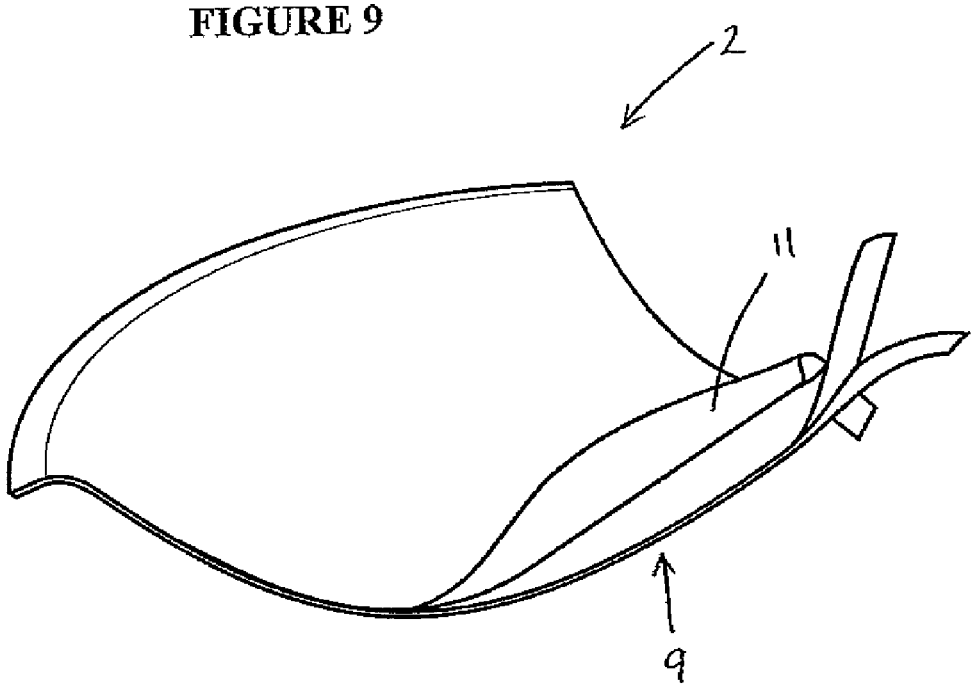
FIG. 9 is another view of the bra cup of FIG. 7 looking at the inside (concave side)

FIGS. 7, 8 and 9 show a precursor bra cup 2 after it has been molded. FIG. 7 is a view from the front (the outer or convex side or face) of the precursor bra cup 2 showing the locations of the neckline edge 9 and the underarm edge 10. FIG. 8 shows the precursor bra cup 2 from the back (the inner or concave side or face), with the inner fabric layer 11 pulled back slightly at the underarm edge 10 region. FIG. 9 shows the precursor bra cup 2 from the back (the inner or concave side or face), with the inner fabric layer 11 pulled back slightly in the neckline edge 9 region.

Figure 2:
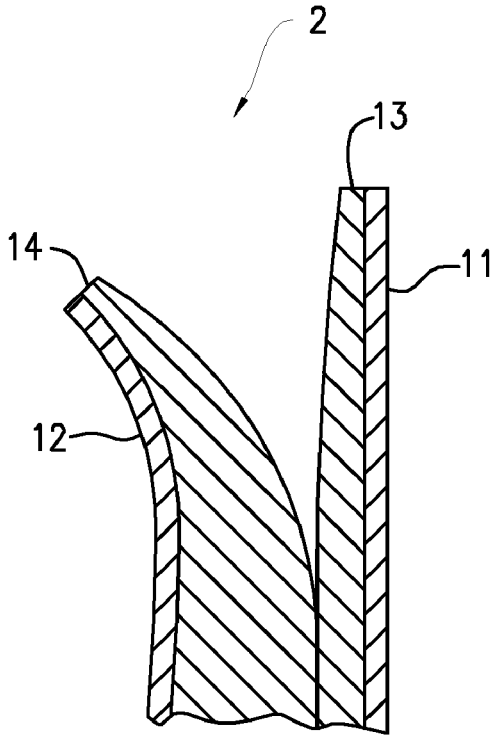
FIG. 2 is a cross section view of part of an edge region of a bra cup.

FIG. 2 shows in cross section an edge of the precursor bra cup 2 of FIGS. 7 to 9. The edge shown may for example be the neckline edge 9 or underarm edge 10 of the precursor bra cup 2.

The precursor bra cup 2 may have an inner fabric layer 11 and an outer fabric layer 12. The inner and outer fabric layers 11 and 12 may be laminated with foam layers 13 and 14 respectively. The foam is preferably polyurethane foam. The foam layers 13 and 14 may be adhered to each other. In the preferred embodiment of the invention the foam layers are adhered to each other through heat pressing with adhesive, however any other means of adhesion may be employed.

The inner and outer fabric layers are preferably of a fabric material such as a synthetic woven material that may include polyester and may be of a kind commonly known as spandex. Alternatively, the inner and outer layers may be of any other suitable material, such as fabric made of 80% Tactel and 20% lycra, or any other know material/fabirc.

Towards the outer edge of the precursor bra cup, i.e., in the region of the neckline edge 9 and/or in the region of the underarm edge 10 of the precursor bra cup, the foam layers 13 and 14 may not be adhered to one another.

The non-adherence at the free edges may be accomplished through the insertion of a release paper (preferably including a coating of silicone) between the two foam layers 13 and 14 to prevent the adhering of the two foam layers 13 and 14 when the precursor bra cup is subjected to heat pressing and molding. The two foam layers at the neckline and/or underarm edge region may be subsequently adhered together later in the edge finishing process. In which case, the release paper is removed to allow for the adhesion.

FIG. 2 shows that the precursor bra cup 2 tapers towards the outer edge (the neckline edge 9 and/or the underarm edge 10), i.e., towards the outer edge of the precursor bra cup, the thickness gradually reduces.

Figure 10:
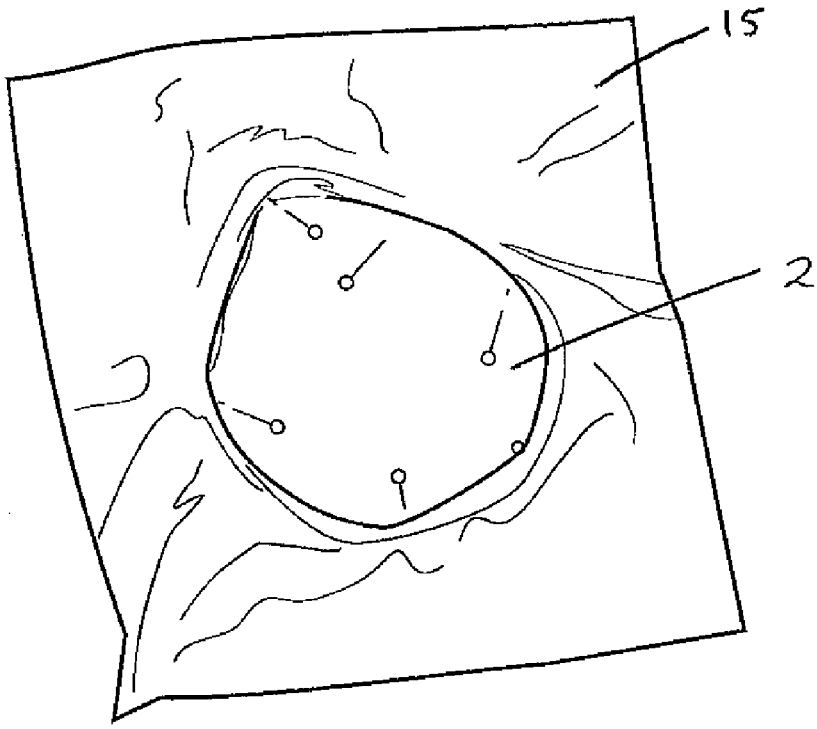
FIG. 10 shows the bra cup of FIG. 7 with an outer most layer placed over the outer face (convex side) of the cup.

FIG. 10 shows the overlaying of an outermost layer 15 over the outer side or face of the molded precursor bra cup 2. The outermost layer 15 is preferably satin, however it can be of any other material such as lace.

Figure 11:
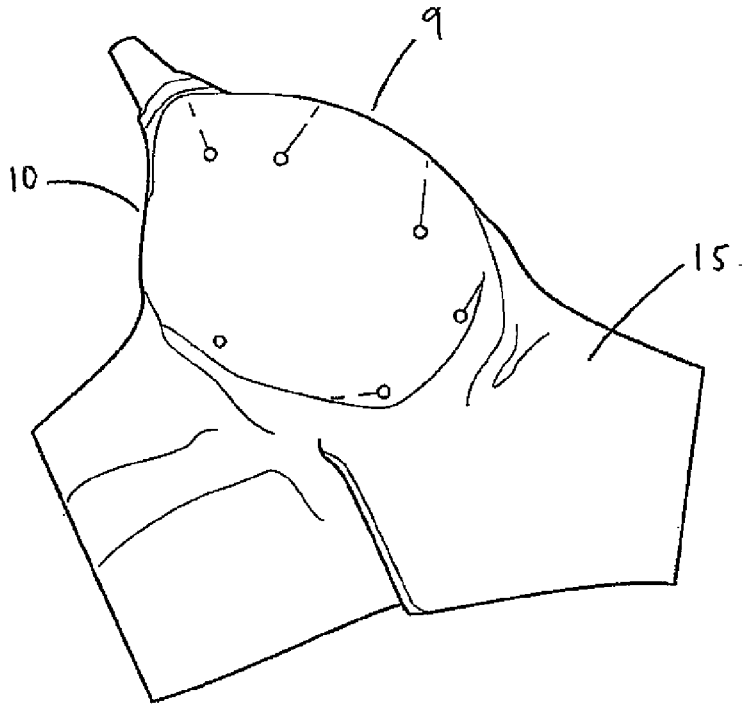
FIG. 11 shows the bra cup of FIG. 10 with a portion of the outer most layer trimmed from the neckline and underarm edge of the bra cup.
Figure 12:
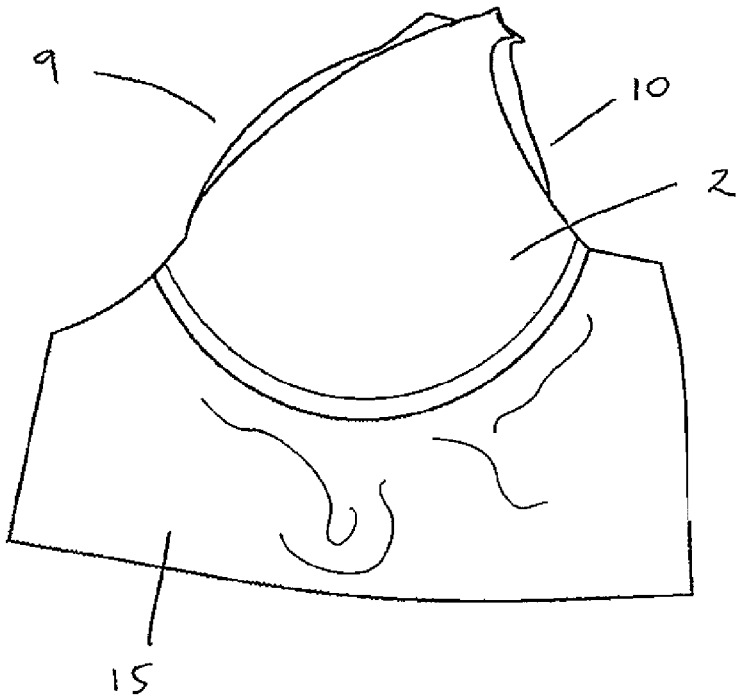
FIG. 12 shows the bra cup of FIG. 7 with the trimmed outer most layer re-positioned on the inner side (concave side) of the bra cup.

FIGS. 11 and 12 show the outermost layer 15 after it has been trimmed near the neckline edge 9 and the underarm edge 10. The outermost layer may be held in place by pins as for example shown in FIGS. 10 and 11 as it is being trimmed. It is preferred that the outermost layer 15 is trimmed in such a way that it slightly overhangs the neckline edge 9 and underarm edge 10 of the precursor bra cup.

Figure 13:
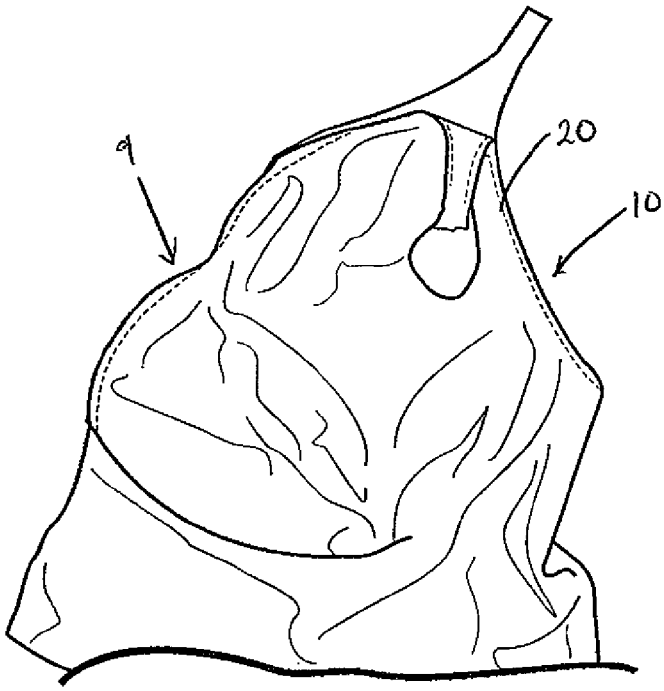
FIG. 13 shows the bra cup of FIG. 12 looking at the inside (concave side) after the outer most layer has been sewn onto the inner fabric layer.
Figure 14:
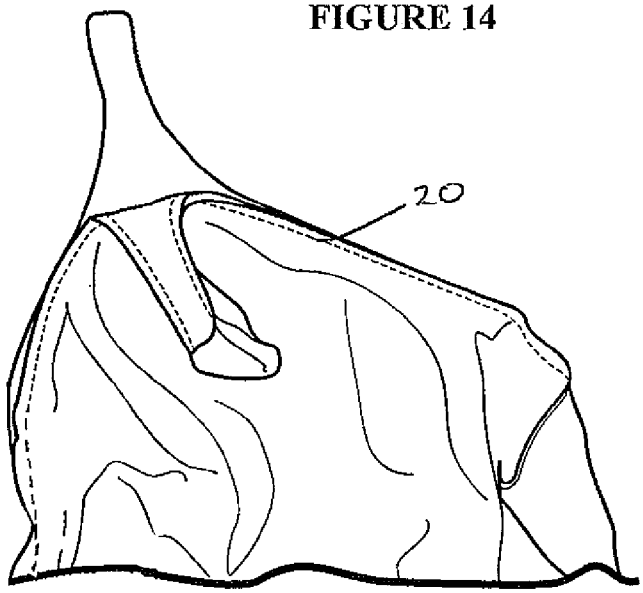
FIG. 14 shows another view of the bra cup of FIG. 12 looking at the inside (concave side) after the outer most layer has been sewn onto the inner fabric layer.

After the outermost layer 15 has been trimmed, the pins may be removed and the outermost layer is then placed over the inner fabric layer 11 as shown in FIG. 12. Once it is placed over the inner fabric layer 11, the outermost layer 15 is sewn to the inner fabric layer 11 at a position proximal to the neckline edge 9 and the underarm edge 10. The line of sewing 20 is depicted in FIGS. 13 and 14.

Figure 3:
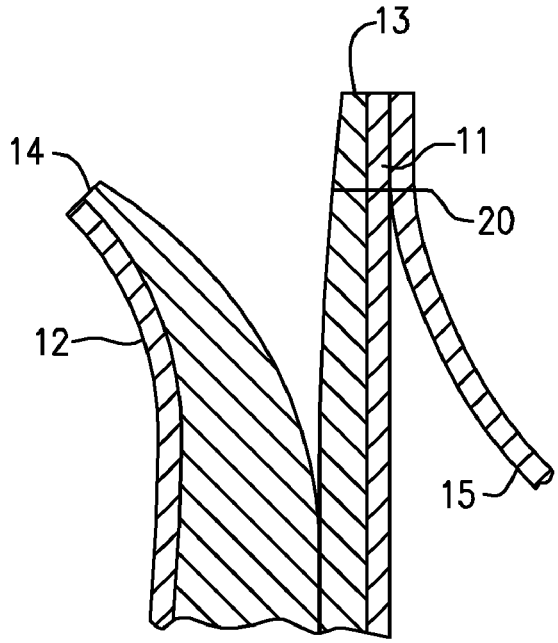
FIG. 3 is a cross section view of an edge region of a bra cup with the outer most layer sewn onto the inner fabric layer.

FIG. 3 shows in cross section an edge portion of a precursor bra cup 2 with the outer most layer 15 sewn at point 20 to the inner fabric layer 11 and the foam layer 13 laminated with the inner fabric layer 11. In the preferred embodiment the line of sewing is approximately 1-2 mm from the outer edge (i.e., the neckline or the underarm edge) of the inner fabric layer 11.

The outer most layer 15 is sewn to the inner fabric layer in order to fix the outermost layer in position relative to the inner fabric layer 11 during the initial stage of the edge finishing process, but, as will be explained below, the sewn line will disappear in the final product.

Figure 4:
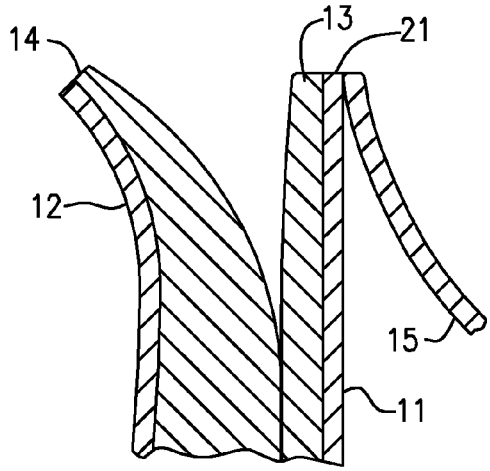
FIG. 4 is a cross section view of an edge region of a bra cup after the outermost layer and inner layer have been ultrasonically cut.

After the sewing of the outermost layer 15 to the inner fabric layer 11, with reference to FIG. 4, the outermost layer 15 and the inner fabric layer 11 (and the associated foam layer 13) may then be ultrasonically cut at point 21, and at the same time the outermost layer 15 is ultrasonically joined to the inner fabric layer 11 at the point of cutting. As shown in FIG. 4, the ultrasonic cutting removes the portion of the inner fabric layer 11 (and associated foam layer 13) together with the outer most layer 15 between point 21 and the free edge. Therefore there is a disparity between the free edge of the inner fabric layer 11 (and associated foam layer 13) and the free edge of the outer fabric layer 12 (and associated foam layer 14). In other words, at the neckline edge region and/or the underarm edge region of the bra cup, the free edge of the inner fabric layer 11 (and associated foam layer 13) and the free edge of the outer fabric layer 12 (and associated foam layer 14) are not contiguous, i.e., they do not touch each other and there is a gap between them.

Figure 6:
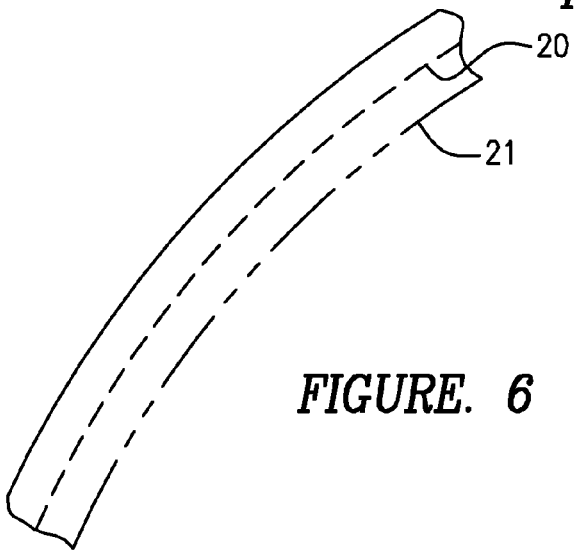
FIG. 6 shows the edge of a bra cup and the respective locations where the outer most layer is sewn to the inner fabric layer and where the outer most layer and the inner fabric layer are ultrasonically cut.

Preferably the ultrasonic cutting takes place approximately 2-6 mm from the free edge. Therefore the aforementioned gap is approximately 2-6 mm. As the sewn line was located approximately 1-2 mm from the free edge, the ultrasonic cutting has cut away the sewn line 20. FIG. 6 shows the locations of the line of sewing 20 and the line of ultrasonic cutting 21 in relation to the edge of the bra cup at the neckline edge region or the underarm edge region.

Figure 15:
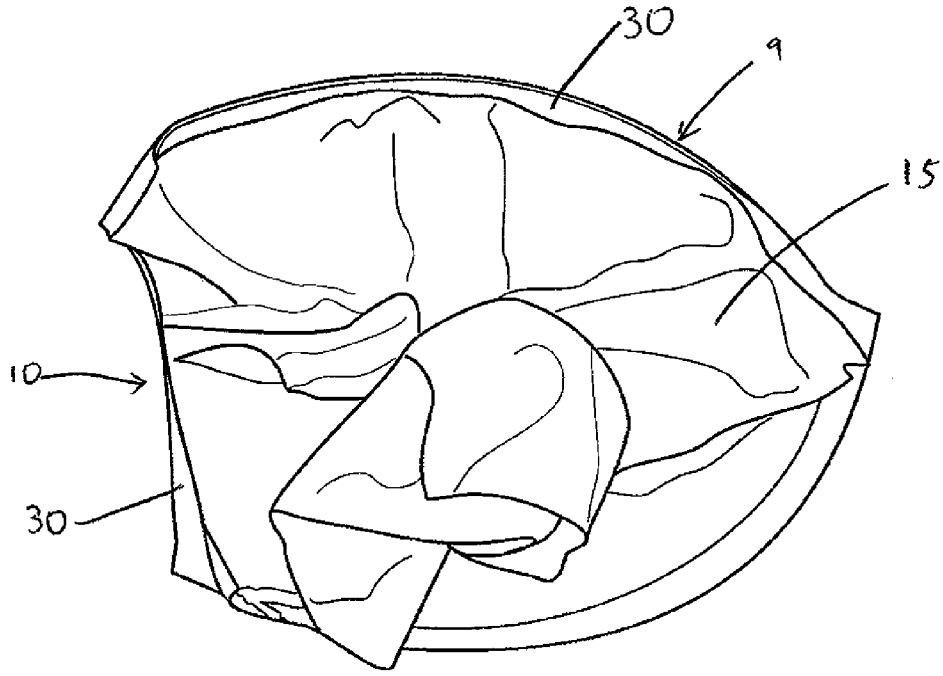
FIG. 15 shows the bra cup of FIG. 14 looking at the inside (concave side) with an adhesive film applied to the inner side of the outer foam layer.

With reference to FIG. 15, an adhesive film 30, such as a heat melt adhesive film, may be applied to the inner side of the foam layer 14 that is laminated with the outer fabric layer 12. It is preferred that the adhesive film 30 is applied to the inner side of the foam layer 14 substantially along the extent of the neckline edge 9 and the underarm edge 10. One purpose of this adhesive film 30 is to facilitate the subsequent affixing of the two foam layers 13 and 14 at regions where they have not yet been affixed to each other.

Figure 5:
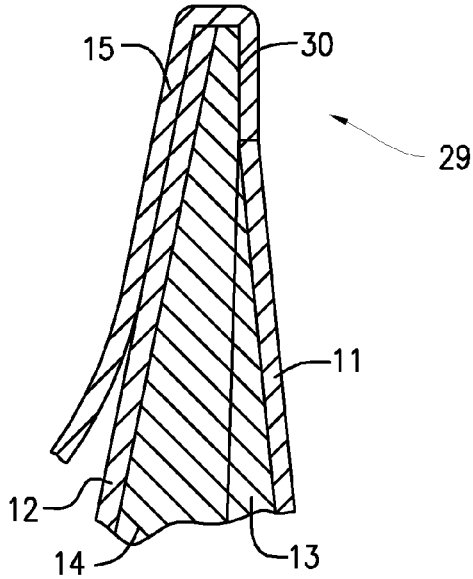
FIG. 5 is a cross section view of an edge region of a bra cup with the outer most layer being folded over the edge of the outer fabric layer.

The outermost layer 15 may then be folded over the edge of the outer fabric layer 12 (and the associated foam layer 14), so that the outermost layer 15 is located substantially on the outer or convex side or face of the bra cup 2 as shown with reference to FIG. 5. At the hem region 29, i.e., the region about which folding of the outermost layer 15 occurs, the portion of the outermost layer 15 that remains on the inner or concave side or face of the cup may be subjected to heat pressing or molding to adhere it to the inner side of the foam layer 14 that is laminated with the outer fabric layer 12. The hot melt adhesive film 30, which is activated by heat, may facilitate the adhering. The hem region 29, and towards the hem region 29 where the two foam layers 13 and 14 are not yet adhered to each other, are preferably subjected to molding, so as to result in a smooth reduction in thickness on the inner or concave side of the bra cup, as dictated by the shape of the mold, from the inner fabric layer 11 to the outermost layer 15 and towards the neckline or underarm edge. A preferred embodiment of the completed bra cup is thus formed. The outermost layer 15 is not only ultrasonically joined to the inner fabric layer 11, but is also adhered to the inner side of the foam layer 14 along the hem region 29 by way of heat pressing or molding and/or the adhesive film 30. Towards the hem region 29 where the two foam layers 13 and 14 are not yet adhered to each other, the two foam layers 13 and 14 may also be adhered to each other through heat pressing or molding. The adhesive film 30 may again facilitate such adhering of the two foam layers 13 and 14 near the hem region. With such a completed bra cup, although the ultrasonic bond alone between the outermost layer 15 and the inner fabric layer 11 at point 21 may not be a very strong bond, the adhering of the outermost layer to the inner side of the foam layer 14 by way of heat pressing or molding and the adhesive film 30 would compensate for the relatively weak ultrasonic bond between the outermost layer 15 and the inner fabric layer 11 to result in a robust hem formed at the region of the neckline and/or underarm edges.

In the preferred embodiment of the present invention a foam layer is laminated to each of the outer and inner layers 12 and 11 respectively. It should however be appreciated that it is not necessary that both foam layers should be present. The foam layer(s), if present, form the intermediate layer(s) of the bra cup, i.e., the layer(s) between the inner fabric layer and the outermost layer. Indeed, the present invention does not require a foam layer to be necessary, although it does require an intermediate layer, i.e., a layer of material between the outermost layer 15 and the inner layer 11, to be present.

The foam layer(s) may not be coextensive with the other layers in the assembly of layers making up the bra cup.

As shown in FIG. 5, the edge of the inner fabric layer 11 corresponding to the hem region 29 is not contiguous with, or does not touch, the corresponding edge of at least one intermediate layer. In the embodiment shown in FIG. 5, the edge of the inner fabric layer 11 is not contiguous with the corresponding edge of the foam layer 14. The non-contiguous nature means that the edge of the inner layer 11 is set away from the edge of at least one intermediate layer which provides a reduced thickness of the bra cup at the hem region. Thus, the thickness or the average thickness at the hem region is less than the thickness at the rest of the bra cup or at a substantial part of the rest of the bra cup, or at least is less than the thickness of the bra cup immediately next to the hem region on the side towards the centroid of the bra cup.

In addition, as shown in FIG. 5, at the hem region 29, the number of layers of material is less than the number of layers of material at the rest of the bra cup or over a substantial part of the rest of the bra cup or immediately next to the hem region on the side towards the centroid of the bra cup. This is so because at least one layer of the assembly of layers making up the bra cup is trimmed or absent at the hem region.

Also, as shown in FIG. 5, on the inner or concave side of the bra cup, the folded-over portion of the outermost layer 15 (as viewed from the inner or concave side of the bra cup, i.e., the portion of the outermost layer that remains on the inner or concave side of the bra cup) is contiguous with and does not overlap the inner layer 11 (and the associated foam layer 13). The folded-over portion of the outermost layer 15 (i.e., the portion of the outermost layer that remains on the inner or concave side of the bra cup) is preferably joined to the inner layer 11 through ultrasonic welding.

Figure 16:
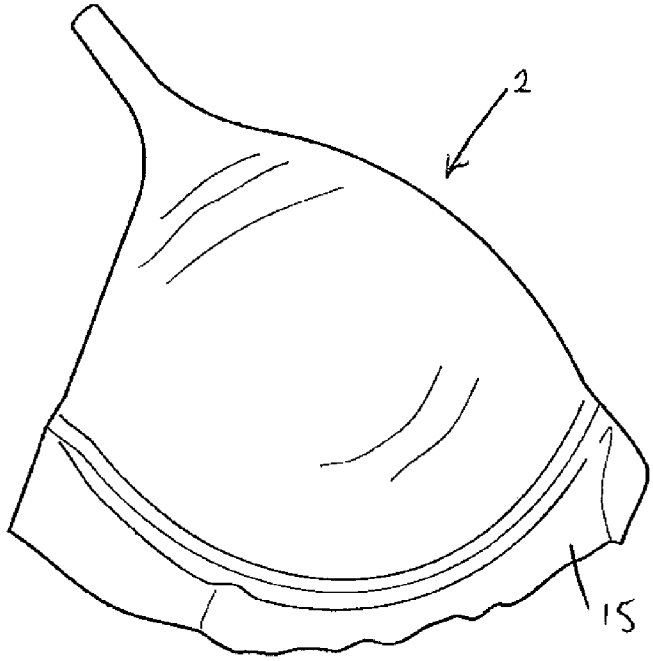
FIG. 16 shows the bra cup of FIG. 15 from the outer side (convex side), after the outer most layer has been folded over the edge.
Figure 17:
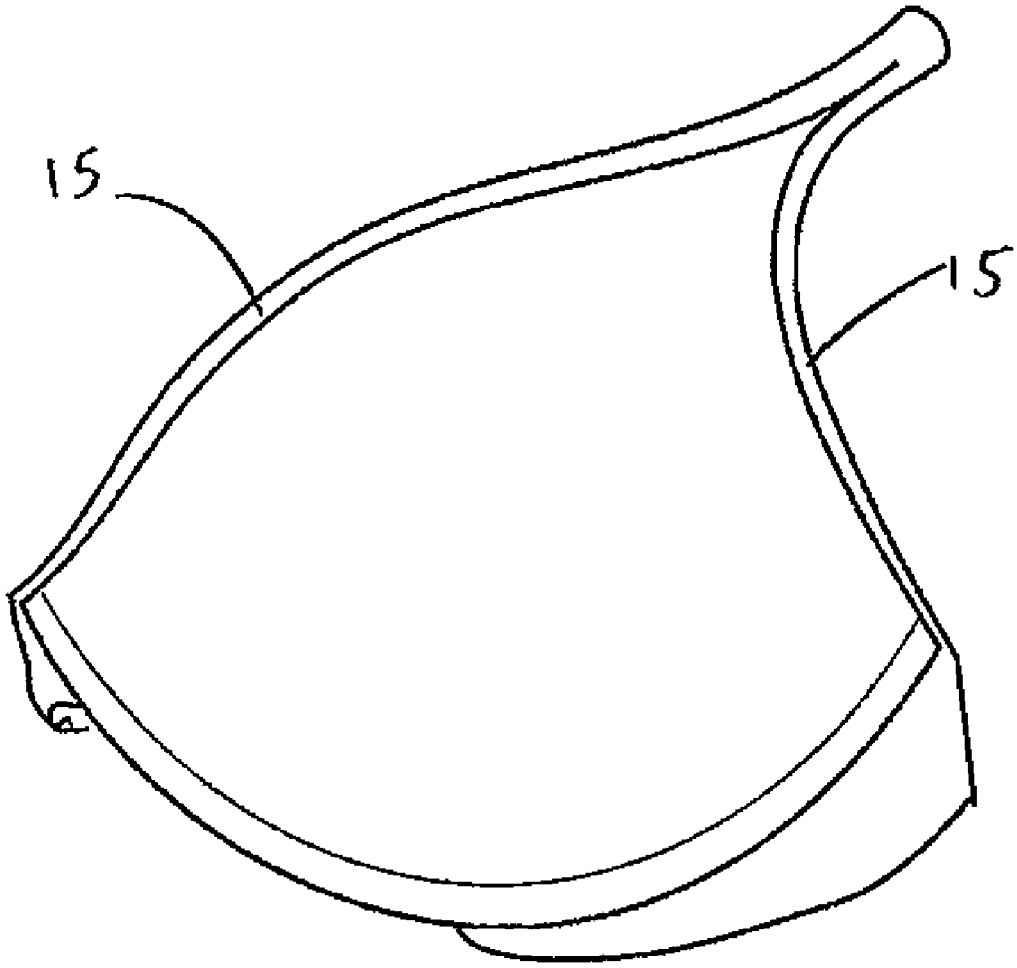
FIG. 17 shows the bra cup of FIG. 15 from the inner side (concave side), after the outer most layer has been folded over the edge.

FIGS. 16 and 17 show the completed bra cup from the outer side and the inner side respectively. The outermost layer is, preferably, not adhered to the outer layer 12; all adhesion is on the inner or concave side of the bra cup. The folded-over portion of the outer most layer 15 is visible from the inner side as shown in FIG. 17.

The completed bra cup 2 may then be connected to the other bra components (shoulder straps 7, chest bands 5, etc) to form a bra. The bra cup 2 may also be engaged to a bottom band (not shown), and underwire (not shown) may also be engaged to it, when a bra is formed.

It should be appreciated that this method of edge finishing a bra cup can also be applied to a molded bra, i.e., a bra made up of an assembly of layers of moldable materials and the layers are laminated and molded to form a bra. In particular, it can be applied to a molded one-piece bra, where the outermost and innermost layers are each a one-piece continuous layer. Thus, FIGS. 2 to 6 would apply similarly to the edge portion of the bra cup part of a molded bra.

However, whether in the case of a standalone bra cup or in the case of a molded bra, as far as the bra cup part is concerned, the edge finishing of this invention may only apply to the neckline edge and/or the underarm edge. This is because a thin edge may not be a desirable feature at the bottom of a bra cup where support is normally required, and also because the manner of securing the outermost layer at the inner side and folding the outermost layer from the inner side to the outer side does not make it possible to fold a continuous piece of outermost layer in the same manner over the whole perimeter of a bra cup.

In the case of a molded bra, in addition to being applied to the neckline edge and/or the underarm edge, the edge finishing of this invention may also be applied to the whole or part of the side bands of the bra as well.

The present invention involves folding of the outermost layer 15 over the edge of the bra cup to form a hem, but the folded-over portion (as viewed from the inner or concave side of the bra cup) is not stitched down or adhered through adhesive means to the innermost layer and does not overlap the innermost layer, but is contiguous with and preferably ultrasonically joined to the innermost layer. The advantage of the present invention is that, as is apparent from FIG. 5, the hem region 29, as identified by the folded-over portion of the outermost layer 15 (as viewed from the inner or concave side of the bra cup), formed by this invention is thinner than a conventional hem formed by stitching down or adhering to an overlapped portion of the innermost layer, because the innermost layer (preferably together with a foam layer laminated to the innermost layer) is absent at the hem region 29. This is so because at least part of the edge of the innermost layer 11 is set inwards away from the corresponding edge of at least one of the other layers of the assembly of layers making up the bra cup, i.e., when viewing the bra cup from the inner or concave side, the edge of the inner layer 11 is located more towards the centroid of the bra cup than the edge of at least one of the other layers of the assembly of layers making up the bra cup.

Thus a thinner edge is achieved by the invention at the neckline and/or the underarm of the bra cup. This improves the aesthetics, and would be especially desirable when T-shirts or other revealing clothes are worn.

Another advantage of the present invention is that the ultrasonic joining of an edge of the folded over portion of the outermost layer (as viewed from the inner or concave side of the bra cup) to the corresponding edge of the innermost layer also makes the transition from the folded over portion to the innermost layer smoother than if, for example, there is a stepped transition which otherwise results from the overlapping of the folded-over portion of the outermost layer with the innermost layer. This smoother transition improves the comfort of the wearer.

While the present invention has been described with reference to particular embodiments thereof, it will be understood that such embodiments are susceptible of modifications and variations without departing from the scope of the present invention and that the invention will include all embodiments falling within the scope of the appended claims.

The invention claimed is:

1. A bra cup having a convex side and a concave side and a first edge and a second edge, the bra cup comprising:

an outer layer of material on the convex side of the bra cup, an inner layer of material on the concave side of the bra cup, the inner layer of material having a first edge corresponding to the first edge of the bra cup and a second edge corresponding to the second edge of the bra cup, and an intermediate layer of material located between the outer layer of material and the inner layer of material, the intermediate layer of material having a first edge corresponding to the first edge of the bra cup and a second edge corresponding to the second edge of the bra cup, wherein the outer layer of material is folded over at least part of at least one of the first edge and the second edge of the intermediate layer of material to the concave side of the bra cup and the folded-over portion of the outer layer of material is contiguous with and does not overlap the inner layer of material.

2. A bra cup as claimed in claim 1, wherein the folded-over portion of the outer layer of material is joined to the inner layer of material through ultrasonic welding.

3. A bra cup as claimed in claim 1, wherein on the concave side of the bra cup, the folded-over portion of the outer layer of material is in contact with and affixed to the intermediate layer of material.

4. A bra cup as claimed in claim 3, wherein the folded-over portion of the outer layer of material is adhesively affixed to the intermediate layer of material.

5. A bra cup as claimed in claim 1, wherein the intermediate layer of material is a foam layer, and the outer and inner layers of material are fabric layers.

6. A bra cup as claimed in claim 1, wherein the intermediate layer of material is made of polyurethane foam.

7. A bra cup as claimed in claim 1, wherein the bra cup includes two zones, the first zone being a zone corresponding to where the folded-over portion of the outer layer of material is present on the concave side of the bra cup, and the second zone being a zone corresponding to where the folded-over portion of the outer layer of material is not present on the concave side of the bra cup, and wherein the average thickness of the bra cup at the first zone is less than the thickness of the bra cup at a substantial part of the second zone.

8. A bra cup as claimed in claim 1, wherein the bra cup includes two zones, the first zone being a zone corresponding to where the folded-over portion of the outer layer of material is present on the concave side of the bra cup, and the second zone being a zone corresponding to where the folded-over portion of the outer layer of material is not present on the concave side of the bra cup, and wherein the average thickness of the bra cup at the first zone is less than the thickness of the bra cup at the second zone immediately next to the first zone.

9. A bra cup as claimed in claim 1, wherein the bra cup includes two zones, the first zone being a zone corresponding to where the folded-over portion of the outer layer of material is present on the concave side of the bra cup, and the second zone being a zone corresponding to where the folded-over portion of the outer layer of material is not present on the concave side of the bra cup, and wherein the total number of layers of material at the first zone is less than the total number of layers of material at a substantial part of the second zone.

10. A bra cup as claimed in claim 1, wherein the bra cup includes two zones, the first zone being a zone corresponding to where the folded-over portion of the outer layer of material is present on the concave side of the bra cup, and the second zone being a zone corresponding to where the folded-over portion of the outer layer of material is not present on the concave side of the bra cup, and wherein the total number of layers of material at the first zone is less than the total number of layers of material at the second zone immediately next to the first zone.

11. A bra cup as claimed in claim 5, wherein the bra cup further comprises a second foam layer, the second foam layer being laminated with the intermediate layer of material.

12. A bra cup as claimed in claim 11, wherein the second foam layer has a first edge corresponding to the first edge of the bra cup and a second edge corresponding to the second edge of the bra cup, wherein at least part of at least one of the first edge and the second edge of the second foam layer does not touch the corresponding first edge or second edge of the intermediate layer of material, and wherein the first edge of the second foam layer comprises a neckline edge that operates to be disposed at least one of on, near and adjacent to a neckline of a garment in or on which the bra cup operates to be disposed, and the second edge of the second foam layer comprises an underarm edge that operates to be disposed at least one of on, near and adjacent to an underarm of the garment.

13. A bra cup as claimed in claim 1, wherein the bra cup further comprises a fabric layer, the fabric layer being located between the outer layer of material and the inner layer of material.

14. A bra cup as claimed in claim 13, wherein the fabric layer has a first edge corresponding to the first edge of the bra cup and a second edge corresponding to the second edge of the bra cup, wherein at least part of at least one of the first edge and the second edge of the fabric layer does not touch the corresponding first edge or second edge of the inner layer of material, and wherein the first edge of the fabric layer comprises a neckline edge that operates to be disposed at least one of on, near and adjacent to a neckline of a garment in or on which the bra cup operates to be disposed, and the second edge of the fabric layer comprises an underarm edge that operates to be disposed at least one of on, near and adjacent to an underarm of the garment.

15. A bra cup as claimed in claim 1, wherein at least part of at least one of the first edge and the second edge of the inner layer of material does not touch the corresponding first edge or second edge of the intermediate layer of material.

16. A bra cup as claimed in claim 1, wherein the folded-over portion of the outer layer of material on the concave side of the bra cup has a width of between 2 to 6 mm.

17. A bra cup as claimed in claim 1, wherein the bra cup is a molded bra cup.

18. A molded bra comprising at least one molded bra cup and a chest band engaged to the at least one molded bra cup, and having an outer side and an inner side and an upper edge and a lower edge, the bra comprising:

an outer layer of material on the outer side of the bra, an inner layer of material on the inner side of the bra, the inner layer of material having an upper edge corresponding to the upper edge of the bra, and an intermediate layer of material located between the outer layer of material and the inner layer of material, the intermediate layer of material having an upper edge corresponding to the upper edge of the bra and is laminated and molded with the inner layer of material to form the at least one molded bra cup, wherein the outer layer of material is folded over at least part of the upper edge of the intermediate layer of material to the inner side of the bra and the folded-over portion of the outer layer of material is contiguous with and does not overlap the inner layer of material.

19. A molded bra as claimed in claim 18, wherein the folded-over portion of the outer layer of material is joined to the inner layer of material through ultrasonic welding.

20. A molded bra as claimed in claim 18, wherein on the inner side of the bra, the folded-over portion of the outer layer of material is in contact with and affixed to the intermediate layer of material.

21. A molded bra as claimed in claim 18, wherein the folded-over portion of the outer layer of material is adhesively affixed to the intermediate layer of material.

22. A molded bra as claimed in claim 18, wherein the intermediate layer of material is made of foam.

23. A molded bra as claimed in claim 18, wherein the at least one molded bra cup has a first edge and a second edge and the intermediate layer of material has first edges and second edges corresponding to the first edges and second edges of the at least one molded bra cup, wherein the at least part of the upper edge of the intermediate layer of material includes a substantial part of the first edges and second edges of the intermediate layer of material, and wherein the first edge of at least one of the at least one molded bra cup and the intermediate layer of material comprises a neckline edge that operates to be disposed at least one of on, near and adjacent to a neckline of a garment in or on which the bra cup operates to be disposed, and the second edge of at least one of the at least one molded bra cup and the intermediate layer of material comprises an underarm edge that operates to be disposed at least one of on, near and adjacent to an underarm of the garment.

24. A method of forming a bra cup, the method comprising the steps of:

a) Forming a precursor bra cup by laminating at least a substantial portion of at least an outer layer of material, an intermediate layer of material, and an inner layer of material, and molding the layers of material to a cup shape;

b) At a set distance inward from at least one of a first edge and a second edge of the precursor bra cup, trimming at least the inner layer of material, but excluding the outer layer of material and the intermediate layer of material, to result in a reduction in thickness of the precursor bra cup at least a region in the vicinity of the first edge and/or the second edge of the precursor bra cup; and c) Placing an outermost layer of material over the outer layer of material in such a manner that the outermost layer of material is folded over at least part of at least one of a first edge and a second edge of the intermediate layer of material, the first edge and the second edge of the intermediate layer of material corresponding to the first edge and the second edge of the precursor bra cup, to a concave side of the bra cup and the folded-over portion is contiguous with and does not overlap the inner layer of material.

25. A method as claimed in claim 24, wherein the method further comprises the step of affixing the folded-over portion of the outermost layer of material to the intermediate layer of material on the concave side of the bra cup.

26. A method as claimed in claim 25, wherein the affixing is accomplished by adhesive means.

27. A method as claimed in claim 24, wherein the method further comprises the step of securing the outermost layer of material at the concave side of the bra cup.

28. A method as claimed in claim 24, wherein the method further comprises the step of joining at least part of an edge of the outermost layer of material to at least part of an edge of the inner layer of material by ultrasonic welding.

29. A method as claimed in claim 24, wherein the trimming in step b) is accomplished by ultrasonic cutting.

30. A method as claimed in claim 24, wherein the method further comprises, prior to step b), the step of affixing the outermost layer of material to the inner layer of material.

31. A bra that includes at least one breast cup, the at least one breast cup having a neckline perimeter region and an underarm perimeter region and comprising an outermost fabric layer and an innermost layer and at least one intermediate layer that comprises a foam layer that is intermediate of at least part of the outermost fabric layer and inner most layer, wherein the outermost fabric layer at least part of at least one of the neckline perimeter region and underarm perimeter region of the at least one breast cup, defines such perimeter region(s) by providing a hem region of said outermost fabric layer, secured at the innermost layer side of the at least one breast cup.

32. A bra as claimed in claim 31, for the at least one breast cup, the hem is secured at the innermost layer side of the at least one breast cup, relative the foam layer.

33. A bra as claimed in claim 31 wherein the hem is secured to the innermost layer.

34. A bra as claimed in claim 31 wherein the hem is engaged to the inner most layer at a perimeter region of the inner most region.

35. A bra as claimed in claim 31 wherein the perimeter region or regions of the innermost layer at least those parts thereof corresponding to where the hem is provided, is/are complementary but not contiguous the corresponding perimeter region or regions of at least one intermediate layer so as to be set away from the perimeter region(s) of the at least one intermediate layer.

36. A bra as claimed in claim 34 wherein the perimeter region or regions of the innermost layer at least those parts thereof corresponding to where the hem is engaged thereto, is/are complementary but not contiguous the corresponding perimeter region or regions of at least one intermediate layer so as to be set away from the perimeter or perimeters of said at least one intermediate layer.

37. A bra as claimed in claim 36 wherein at least two intermediate layers are provided, one of which is said foam layer and wherein the perimeter region or regions of the innermost layer at least those parts thereof corresponding to where the hem is engaged thereto, is/are contiguous the perimeter region(s) of at least one of the intermediate layers.

38. A bra as claimed in claim 37 wherein there are two intermediate foam layers.

39. A bra as claimed in claim 38 wherein the two intermediate foam layers are juxtaposed each other.

40. A bra as claimed in claim 38 wherein the foam layer more proximate the innermost layer has a perimeter region or regions that correspond with the region or regions where the hem is provided, and are contiguous at such region(s) with the perimeter of the innermost layer.

41. A bra as claimed in claim 40 wherein the foam layer more distal the innermost layer has a perimeter region or regions that correspond with the region or regions where the hem is provided, and are contiguous the neckline perimeter region and underarm perimeter region at such region(s).

42. A bra as claimed in claim 37 wherein the intermediate layer includes an intermediate fabric layer that is provided on the more distal side of the foam layer relative to the inner most layer, said fabric layer positioned juxtaposed the outermost fabric layer.

43. A bra as claimed in claim 42 wherein the intermediate fabric layer has at least one perimeter region that is contiguous the neckline perimeter region and underarm perimeter region.

44. A bra as claimed in claim 31 wherein the outermost fabric layer is secured at the hem at the innermost layer side of the at least one breast cup by ultrasonic welding.

45. A bra as claimed in claim 31 wherein the outermost fabric layer is secured at the hem in a manner such that the side of the outermost fabric layer at the hem that is also the outward facing side of the outermost fabric layer is the side in contact at the innermost side of the at least one breast cup.

46. A bra as claimed in claim 33 wherein the outermost fabric layer is secured to the innermost layer at the hem in a manner such that the side of the outermost fabric layer at the hem that is also the outward facing side of the outermost fabric layer is the side in contact with the inner most layer.

47. A bra as claimed in claim 31 wherein the outermost fabric layer is juxtaposed the intermediate layer but is not affixed thereto.

48. A bra as claimed in claim 31 wherein the outermost fabric layer is not affixed by being laminated to any of the layers, other than at its perimeter region.

49. A bra that includes at least one breast cup, the at least one breast cup having a neckline perimeter region and an underarm perimeter region and comprising an outermost fabric layer and an innermost layer and at least one intermediate layer that comprises foam layer that is intermediate of at least part of the outermost fabric layer and inner most layer, wherein the outermost fabric layer at least part of at least one of the neckline perimeter region and underarm perimeter region of the at least one breast cup, defines such perimeter region(s) by providing a hem region of said outermost fabric layer, secured at the innermost layer side of the at least one breast cup to the innermost layer at a perimeter region of the inner most region, wherein the perimeter region or regions of the innermost layer at least those parts thereof corresponding to where the hem is engaged thereto, is/are complementary but not contiguous the corresponding perimeter region or regions of the at least one of the intermediate layer so as to be set away from the perimeter or perimeters of said at least one intermediate layer to define a reduction in thickness of the at least one breast cup at said perimeter region or regions.

50. A bra that includes at least one breast cup, the at least one breast cup having a neckline perimeter region and an underarm perimeter region and comprising an assembly of layers comprising:

a. outermost fabric layer, b. an innermost layer, and c. at least one intermediate layer comprising a foam layer that is -intermediate of at least part of the outermost fabric layer and inner most layer, wherein the outermost fabric layer at least part of at least one of the neckline perimeter region and underarm perimeter region of the at least one breast cup has a hem region thereof secured to the innermost layer at a perimeter region of the inner most region, and wherein at least part of said perimeter region of at least the inner most layer is parallel to and set inwards away from the perimeter of at least one of the other layers of the assembly of layers.

51. A bra cup as claimed in claim 1 wherein the first edge of the bra cup comprises a neckline edge that operates to be disposed at least one of on, near and adjacent to a neckline of a garment in or on which the bra cup operates to be disposed, and the second edge of the bra cup comprises an underarm edge that operates to be disposed at least one of on, near and adjacent to an underarm of the garment.

52. A method as claimed in claim 24 wherein at least one of the first edge of the precursor bra cup and the first edge of the intermediate layer of material comprises a neckline edge that operates to be disposed at least one of on, near and adjacent to a neckline of a garment in or on which the bra cup operates to be disposed, and at least one of the second edge of the precursor bra cup and the second edge of the intermediate layer of material comprises an underarm edge that operates to be disposed at least one of on, near and adjacent to an underarm of the garment.

* * * * *

UNITED STATES PATENT AND TRADEMARK OFFICE

CERTIFICATE OF CORRECTION

PATENT NO. : 8,133,091 B2
APPLICATION NO. : 12/272251
DATED : March 13, 2012
INVENTOR(S) : Zhen Qiang Liu It is certified that error appears in the above-identified patent and that said Letters Patent is hereby corrected as shown below:

Claim 24, column 16, line 45: "cup at least a region in the vicinity of the first edge and/or" should be changed to --cup at at least a region in the vicinity of the first edge and/or--.

Claim 31, column 17, line 14: "wherein the outermost fabric layer at least part of at least one" should be changed to --wherein the outermost fabric layer at at least part of at least one--.

Claim 35, column 17, line 30: "region or regions of the innermost layer at least those parts" should be changed to --region or regions of the innermost layer at at least those parts--.

Claim 36, column 17, line 37: "region or regions of the innermost layer at least those parts" should be changed to --region or regions of the innermost layer at at least those parts--.

Claim 37, column 17, line 46: "innermost layer at least those parts thereof corresponding to" should be changed to --innermost layer at at least those parts thereof corresponding to--.

Claim 49, column 18, line 30: "wherein the outermost fabric layer at least part of at least one" should be changed to --wherein the outermost fabric layer at at least part of at least one--.

Claim 49, column 18, line 38: "layer at least those parts thereof corresponding to where" should be changed to --layer at at least those parts thereof corresponding to where--.

Claim 50, column 18, line 53: "that is -intermediate of at least part of the outermost" should be changed to --that is intermediate of at least part of the outermost--.

Claim 50, column 18, line 55: "wherein the outermost fabric layer at least part of at least" should be changed to --wherein the outermost fabric layer at at least part of at least--.

Signed and Sealed this
First Day of May, 2012

David J. Kappos

David J. Kappos
*Director of the United States Patent and Trademark Office*